US011512923B2

(12) United States Patent
Trpkovski

(10) Patent No.: US 11,512,923 B2
(45) Date of Patent: Nov. 29, 2022

(54) PROJECTILE GUIDE

(71) Applicant: Ravin Crossbows, LLC, Superior, WI (US)

(72) Inventor: Paul Trpkovski, Kailua Kona, HI (US)

(73) Assignee: Ravin Crossbows, LLC, Superior, WI (US)

( * ) Notice: Subject to any disclaimer, the term of this patent is extended or adjusted under 35 U.S.C. 154(b) by 0 days.

(21) Appl. No.: 17/384,291

(22) Filed: Jul. 23, 2021

(65) Prior Publication Data

US 2022/0026172 A1 Jan. 27, 2022

Related U.S. Application Data

(60) Provisional application No. 63/055,735, filed on Jul. 23, 2020.

(51) Int. Cl.

| | |
|---|---|
| ***F41B 5/12*** | (2006.01) |
| ***F41B 5/14*** | (2006.01) |
| *F41B 5/06* | (2006.01) |

(52) U.S. Cl.

CPC ..... *F41B 5/143* (2013.01); *F41B 5/12* (2013.01); *F41B 5/1469* (2013.01); *F41B 5/066* (2013.01); *F41B 5/123* (2013.01)

(58) Field of Classification Search

CPC ..... F41B 5/12; F41B 5/123

See application file for complete search history.

(56) References Cited

U.S. PATENT DOCUMENTS

| | | | | |
|---|---|---|---|---|
| 7,588,022 | B2 * | 9/2009 | Chang | F41B 5/123 124/40 |
| 8,978,634 | B2 * | 3/2015 | Darlington | F41B 5/143 124/25 |
| 9,140,516 | B1 * | 9/2015 | Hyde | F41B 5/12 |
| 9,255,755 | B1 * | 2/2016 | Barnett | F41B 5/14 |
| 9,417,029 | B1 * | 8/2016 | Chang | F41B 5/1469 |
| 9,494,379 | B2 | 11/2016 | Yehle | |
| 10,274,281 | B2 * | 4/2019 | Chu | F41A 19/06 |
| 10,378,853 | B1 * | 8/2019 | Liu | F41B 5/1469 |
| 10,508,884 | B1 * | 12/2019 | Chen | F41A 17/46 |

(Continued)

OTHER PUBLICATIONS

Mission Crossbows, 2020 Product Guide, Accessed by Applicant on Jun. 9, 2020, 4 pages.

(Continued)

*Primary Examiner* — John A Ricci

(74) *Attorney, Agent, or Firm* — Foley & Lardner LLP

(57) ABSTRACT

A crossbow includes a frame that has a front end and a stock at a rear end. A projectile moves along a projectile axis that extends between the rear end and the front end during firing. The crossbow includes a power source that is configured to fire the projectile. The crossbow includes a latch that is movable between the rear end and the front end of the frame. The latch has a main body that defines a nock aperture aligned with the projectile axis and configured to receive a portion of the projectile therein. The crossbow includes a projectile guide connected to the main body of the latch and positioned adjacent the projectile axis. The projectile guide is configured to interface with the projectile when the projectile is in a misaligned rotational position, and be positioned between portions of the projectile when the projectile is in an aligned rotational position.

24 Claims, 17 Drawing Sheets

Misaligned

Aligned

(56) References Cited

U.S. PATENT DOCUMENTS

| | | | | |
|---|---|---|---|---|
| 10,690,436 | B1 * | 6/2020 | Kempf | F41B 5/1469 |
| 11,131,524 | B1 * | 9/2021 | Kempf | F41B 5/123 |
| 2016/0290757 | A1 * | 10/2016 | Khoshnood | F41B 5/123 |

OTHER PUBLICATIONS

Gearhead Archery, X16 Crossbow Owner's Manual, Accessed by Applicant on Jun. 9, 2020, 10 pages.
PSE Archery, TAC Crossbow Instructions, Accessed by Applicant on Jun. 9, 2020, 8 pages.
Ravin Crossbows; R Series R26/R29 Instruction Manual; Oct. 2018; 28 pages.

* cited by examiner

Aligned

Misaligned

PROJECTILE GUIDE

CROSS-REFERENCE TO RELATED APPLICATION(S)

This application claims the benefit of U.S. Provisional Patent Application No. 63/055,735, filed Jul. 23, 2020, the disclosure of which is hereby incorporated by reference in its entirety.

BACKGROUND

Crossbows typically include a bow portion, a stock portion, and a draw string latch that holds the bow in the fully drawn position. Typically, the draw string is perpendicular to the arrow or direction of flight. Furthermore, when shooting, the draw string moves aggressively from the drawn position to the undrawn position to propel the arrow forward. Currently, crossbows produce speeds in excess of 400 feet per second (FPS); however, most suffer from inefficiencies, safety issues, left-to-right draw movement, and handling and transporting issues due to their size.

If the arrow is even slightly disrupted as it is propelled from the crossbow, the arrow flight can be thrown off. This results in an inaccurate firing of the arrow and the arrow may travel to a different location from where the user aims the crossbow. Further, improperly loading an arrow into the crossbow may result in the arrow being propelled in a way that the arrow contacts a portion of the crossbow as it is fired.

Therefore improvements are desired.

SUMMARY

This application generally relates to crossbows and other projectile launchers.

In one aspect of the present disclosure, a crossbow is disclosed. The crossbow includes a frame that has a front end and a rear end. The crossbow includes a stock being positioned at the rear end. A projectile is configured to be fired from the front end of the frame, and the projectile moves along a projectile axis that extends between the rear end and the front end during firing. The crossbow includes a power source connected to the frame and the power source is configured to fire the projectile from the front end of the frame. The crossbow includes a latch that is movable between the rear end of the frame and the front end of the frame. The latch has a main body that defines a nock aperture aligned with the projectile axis. The nock aperture is configured to receive a portion of the projectile therein. The crossbow includes a projectile guide connected to the main body of the latch and positioned adjacent the projectile axis. The projectile guide is configured to interface with the projectile when the projectile is in a misaligned rotational position, and the projectile guide is positioned between portions of the projectile when the projectile is in an aligned rotational position.

In another aspect of the present disclosure, a crossbow is disclosed. The crossbow includes a frame that has a front end and a rear end. The crossbow includes a stock being positioned at the rear end. A projectile is configured to be fired from the front end of the frame, and the projectile moves along a projectile axis that extends between the rear end and the front end during firing. The crossbow includes a power source connected to the frame and the power source is configured to fire the projectile from the front end of the frame. The crossbow includes a projectile rest positioned at the front end of the frame. The projectile rest has a pair of arms and a central channel between the pair of arms. The pair of arms are configured to at least partially support the projectile and the projectile axis is positioned between the pair of arms. The crossbow includes a latch that is movable between the rear end of the frame and the front end of the frame. The latch is configured to receive and retain a drawstring powered by the power source. The latch has a main body that defines a nock aperture aligned with the projectile axis. The nock aperture is configured to receive a portion of the projectile therein. The crossbow includes a projectile guide that extends from the main body of the latch toward the projectile rest and adjacent the projectile axis. The projectile guide is positioned closer to the front end of the frame than the nock aperture of the latch.

In another aspect of the present disclosure, a crossbow is disclosed. The crossbow includes a frame that has a front end and a rear end. The crossbow includes a stock being positioned at the rear end. A projectile is configured to be fired from the front end of the frame, and the projectile moves along a projectile axis that extends between the rear end and the front end during firing. The crossbow includes first and second flexible limbs each having a first end attached to the frame. The first and second flexible limbs are in an unloaded position when the crossbow is undrawn and in a loaded position when the crossbow is drawn. The crossbow includes a drawstring being connected to the flexible limbs and the drawstring travels at least partially perpendicular to the projectile axis. The crossbow includes a projectile rest positioned at the front end of the frame. The projectile rest has a pair of arms and a central channel between the pair of arms. The pair of arms is configured to at least partially support the projectile, and the projectile axis is positioned between the pair of arms. The crossbow includes a latch that is movable between the rear end of the frame and the front end of the frame. The latch is configured to receive and retain a drawstring powered by the power source. The latch has a main body that defines a nock aperture aligned with the projectile axis. The nock aperture is configured to receive a portion of the projectile therein. The crossbow includes a trigger assembly that is in communication with the latch. Upon activation of the trigger assembly when firing, the trigger assembly moves the latch and the drawstring is released from the latch. The crossbow includes a projectile guide that extends from the main body of the latch toward the projectile rest and above the projectile axis. The projectile guide is positioned closer to the front end of the frame than the nock aperture of the latch and further from a rail of the frame than the nock aperture of the latch. The projectile guide is configured to interface with the projectile when the projectile is in a misaligned rotational position, and the projectile guide is positioned between portions of the projectile when the projectile is in an aligned rotational position.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

FIG. 1 illustrates the crossbow in a partially drawn position.

DETAILED DESCRIPTION

Various embodiments will be described in detail with reference to the drawings, wherein like reference to numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

A projectile guide disclosed herein prevents a user of a crossbow from improperly aligning vanes of a projectile, such as an arrow, when loading the projectile when a drawstring is drawn. The guide only allows the projectile to be latched at the rear of the crossbow in a single rotational position so that the vanes of the arrow do not contact portions of the crossbow as the arrow is fired from the drawn position.

An example of a crossbow is described in U.S. Pat. No. 9,494,379, the disclosure of which is hereby incorporated by reference in its entirety. To the extent that the terms or description of the present disclosure conflict with or are in any way unclear in view of the terms or description of the incorporated patent disclosure, the terms and description of the present disclosure shall prevail.

Figure 1:
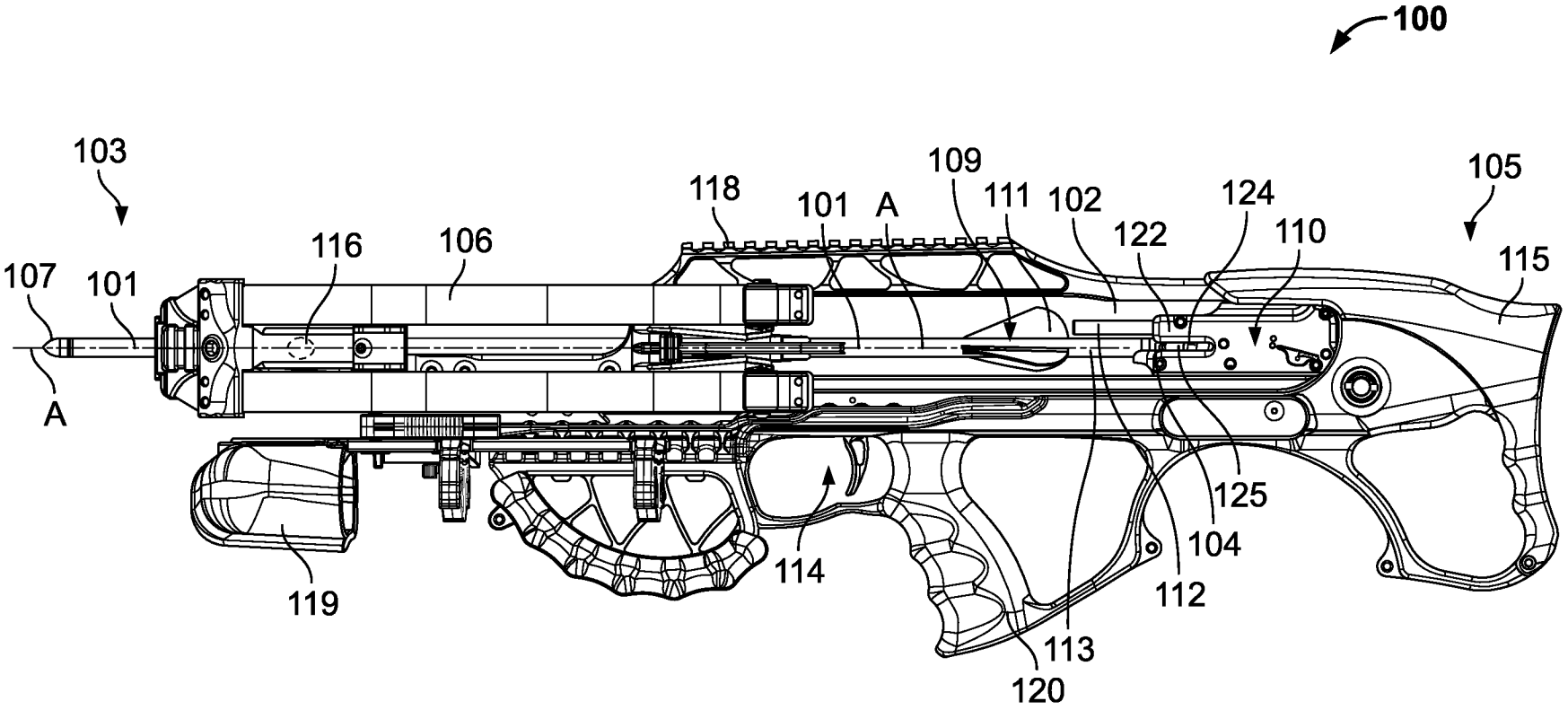
FIG. 1 is a left side view of a crossbow according to the principles of the present disclosure; in particular
Figure 2:
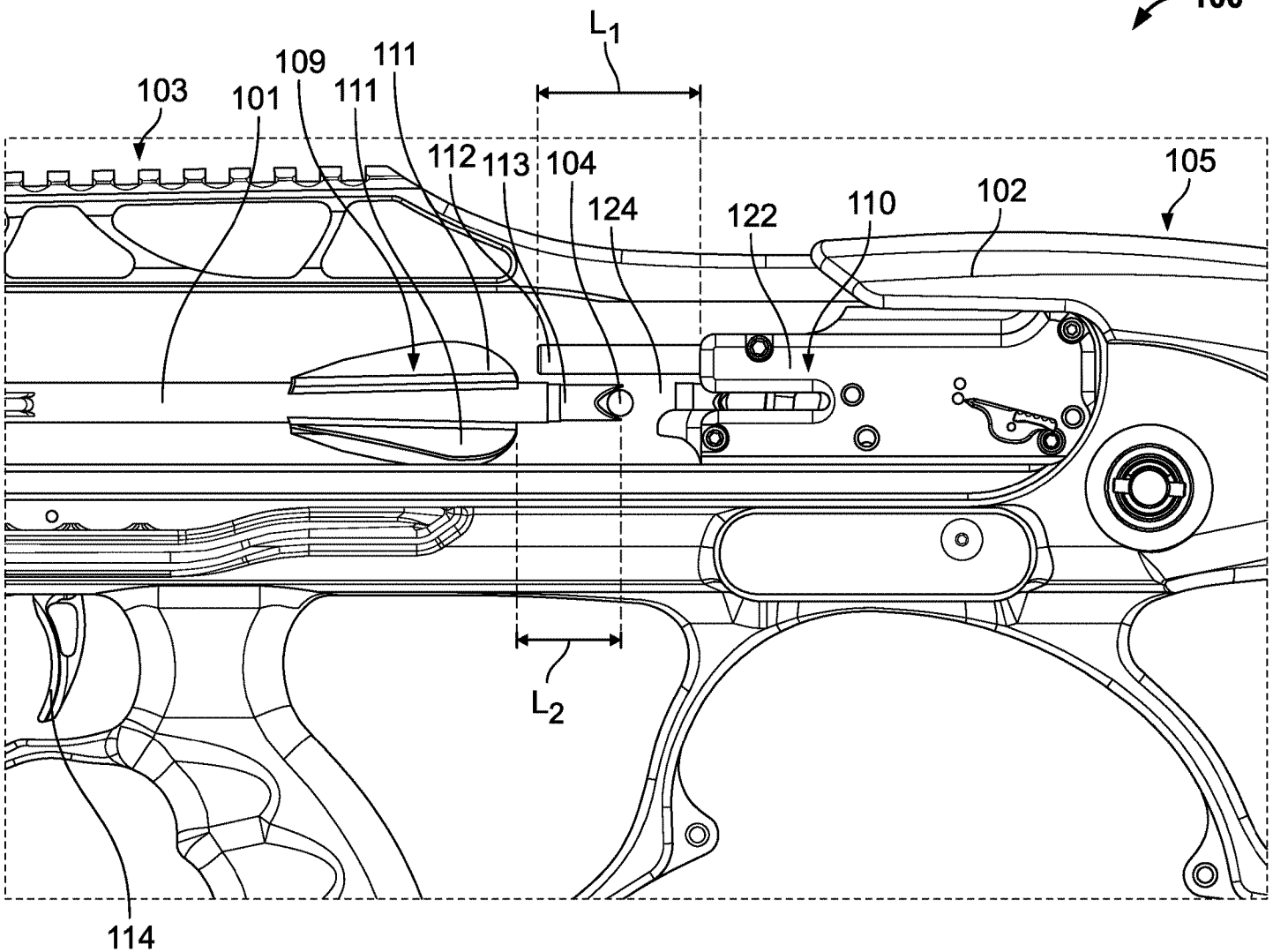
FIG. 2 is a left side view of the crossbow of FIG. 1 in the drawn position.
Figure 3:
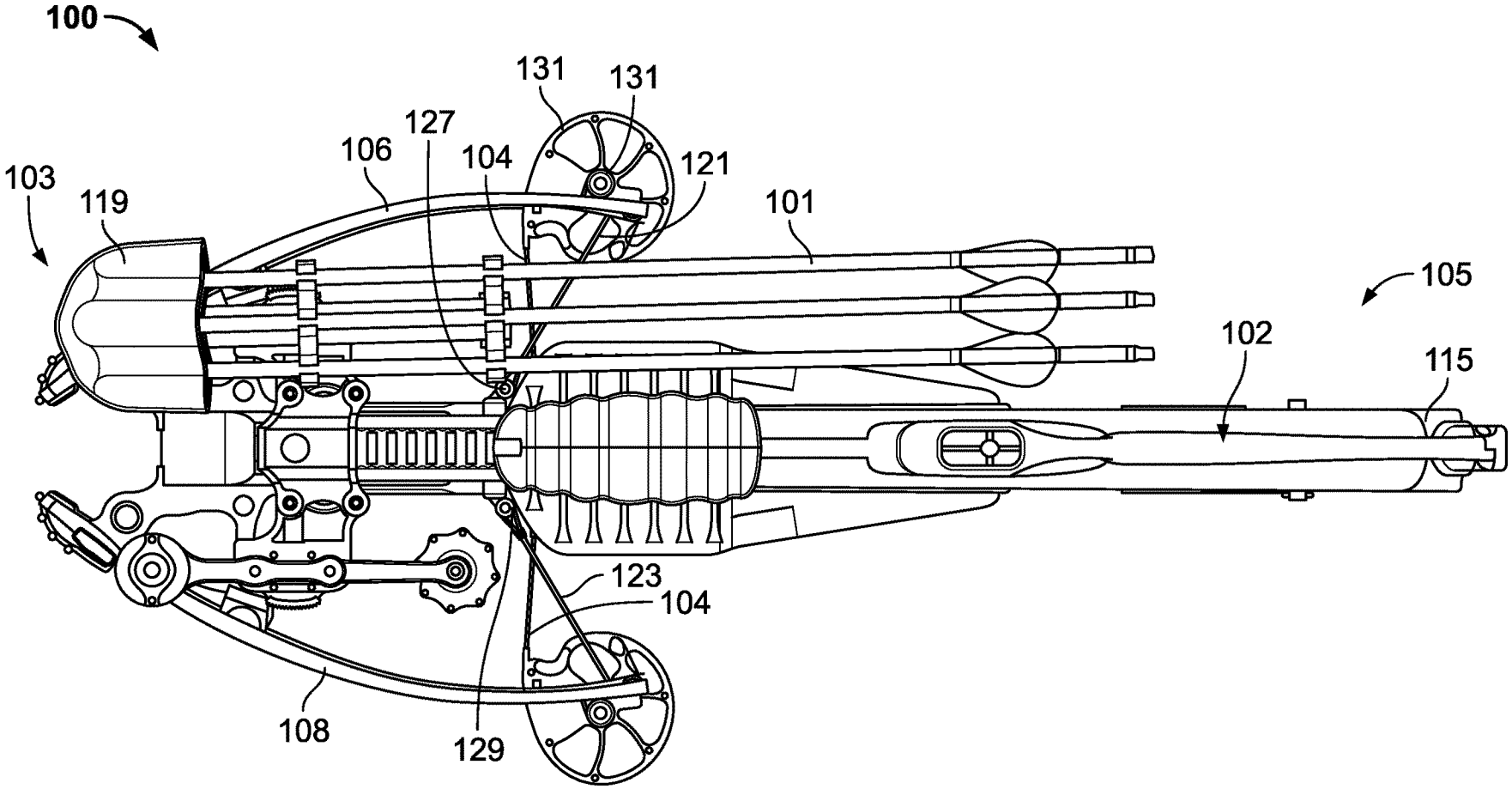
FIG. 3 is a bottom view of the crossbow of FIG. 1.

FIGS. 1-6 illustrate an example of a crossbow 100 according to the principles of the present disclosure. FIG. 1 shows a side view of the crossbow 100. FIG. 2 shows an enlarged portion of a side view of the crossbow 100. FIG. 3 shows a bottom view of the crossbow 100.

The crossbow 100 is configured to fire a projectile 101, such as an arrow. The crossbow 100 includes a frame 102, a drawstring 104 (shown schematically), flexible limbs 106, 108, power cables 121, 123, a latch 110, a projectile guide 112, and a trigger assembly 114. The crossbow 100 also can include a projectile rest 116, an accessory rail 118, a quiver 119 and a grip 120.

The crossbow 100 is shown in a partially drawn position where the drawstring 104 is positioned at a rear end 105 of the frame 102. When fired, the projectile 101 moves within a horizontal projectile plane and along a projectile axis A, and the crossbow 100 fires the projectile 101 from a front end 103 of the frame 102. In some examples, the crossbow 100 is generally symmetrical about a projectile axis A.

The projectile 101 can be a variety of different projectiles such as, but not limited to, an arrow, a metal ball, a metal rod, etc. For example, the projectile 101 shown is an arrow with a pointed tip 107 and fletching 109 to help guide and steer the arrow when the arrow is fired from the crossbow 100. The fletching 109 includes a plurality of vanes 111, and each vane 111 can be constructed of a plurality of different materials such as, but not limited to, feathers and plastic. The projectile 101 also includes a nock 113 positioned adjacent to and behind the fletching 109. The nock 113 is configured to interface with the drawstring 104 so that the drawstring 104 pushes the projectile 101 when the projectile 101 is fired from the crossbow 100.

The frame 102 can be constructed of a composite, wood, metal, or like material. In some examples, the frame 102 includes an integral stock 115 at the rear end 105. In some examples, the stock 115 is attached to, and separate from, the frame 102. In some examples, the crossbow does not include a stock 115 and is instead configured to be fired like a pistol. In some examples, the frame 102 is a singular unibody component. In other examples, the frame 102 has a multiple-piece construction. In some examples, the frame 102 is configured to include a variety of different mounting points for various modular accessories such as a quiver, a scope, a flashlight, or other attachments.

The drawstring 104, in some examples, is connected to the flexible limbs 106, 108. The flexible limbs 106, 108 power movement of the drawstring 104. The drawstring 104 is replaceable when it becomes worn. In some examples, the crossbow 100 is provided without a drawstring 104, and the drawstring 104 can be subsequently added by a user or technician. The drawstring 104 can be constructed of traditional bowstring material such as, but not limited to, composite and/or natural fibers.

The drawstring 104 travels at least partially perpendicular to the projectile axis A. The drawstring 104 is movable within the projectile plane during firing and arming of the crossbow 100. To draw the drawstring 104, the crossbow 100 is stabilized and the drawstring 104 is pulled to the rear end 105 of the frame 102. An arming device, the user's arm, or other like mechanism can be used to draw the drawstring 104.

The limbs 106 and 108 are flexible and are attached to the frame 102. In some examples, the limbs 106, 108 are elastic and spring-like in nature. In some examples, the limbs 106, 108 extend in an outward direction from the frame 102 and in a rearward direction toward the rear end 105 of the frame 102. In some examples, the limbs 106, 108 extend in an upward direction from the frame 102 and in a forward direction toward the front end 103 of the frame 102. It is considered within the scope of the present disclosure that the limbs 106, 108 may be positioned in a variety of different ways relative to the frame 102. The limbs 106, 108 are positioned at either side of the frame 102 such that the projectile 101 passes between the limbs 106, 108.

As shown in the bottom view of FIG. 3, the power cables 121, 123 are secured to the frame 102 at power cable mounting points 127, 129 and secured to the first and second limbs 106, 108. In some examples, the power cables 121, 123 can be wound around elements 131, such as cams, pulley wheels, etc., at the first and second limbs 106, 108. The power cables 121, 123 do not cross one another and are instead attached to the frame 102 at their respective power cable mounting points 127, 129 at the same side of the crossbow 100 that they are attached the respective limbs 106, 108. Because the power cables 127, 129 do not cross the projectile axis A, the crossbow 100 can have narrow construction. In some examples, the power cables 127, 129 can be constructed of a variety of different materials such as, but not limited to, composite and/or natural fibers, metal, plastic, etc.

The latch 110 is configured to hold the drawstring 104 at the rear end 105 of the frame when the crossbow 100 is drawn. The latch 110 has a main body 122 that defines a nock aperture 124 aligned with the projectile axis A. The nock aperture 124 receives a portion of the projectile 101, specifically the nock 113, when the crossbow 100 is drawn. During operation, the drawstring 104 can be positioned with the nock aperture 124 so as to be held within the latch 110 until the crossbow 100 is fired. The projectile 101 can be loaded by positioning the projectile 101 within the nock aperture 124, forward of the drawstring 104.

Figure 4:
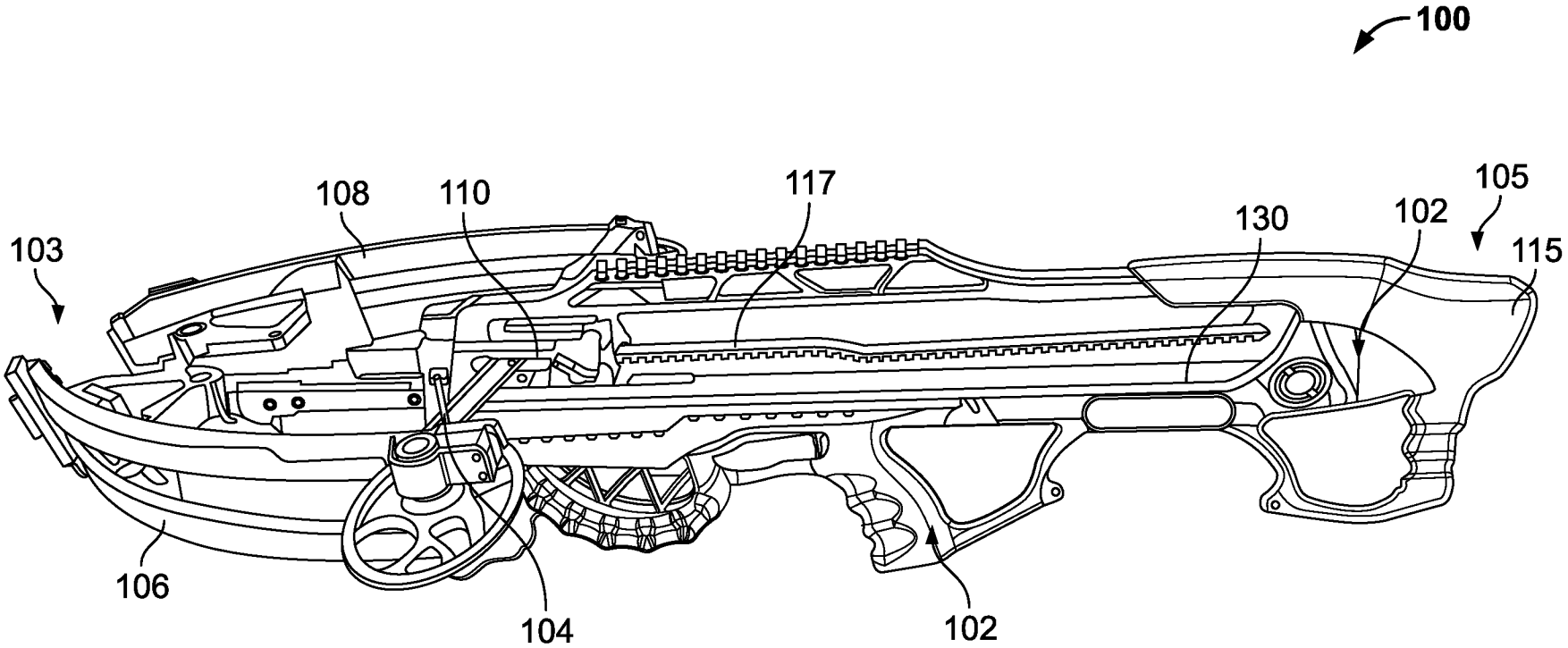
FIG. 4 is a left perspective view of the crossbow of FIG. 1 with a projectile in an aligned rotational position.
Figure 5:
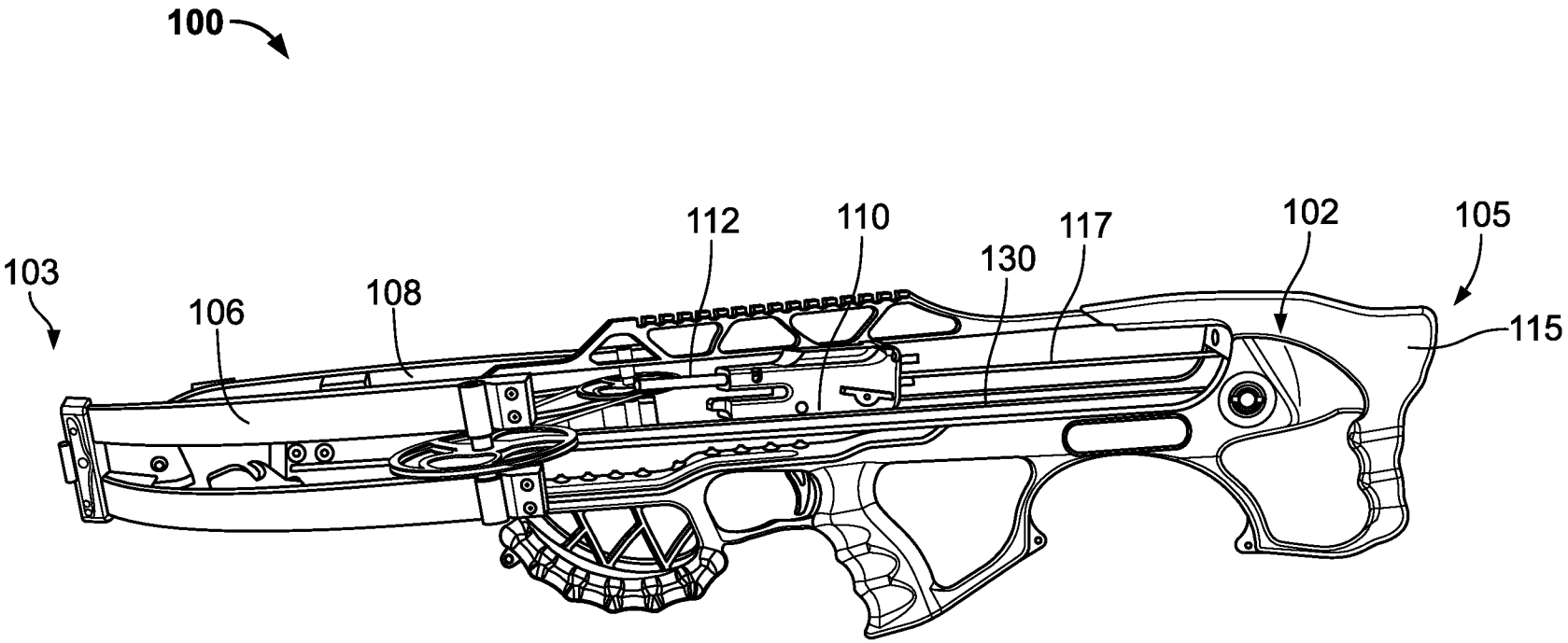
FIG. 5 is a left perspective view of the crossbow of FIG. 1 with a projectile in an aligned rotational position.
Figure 6:
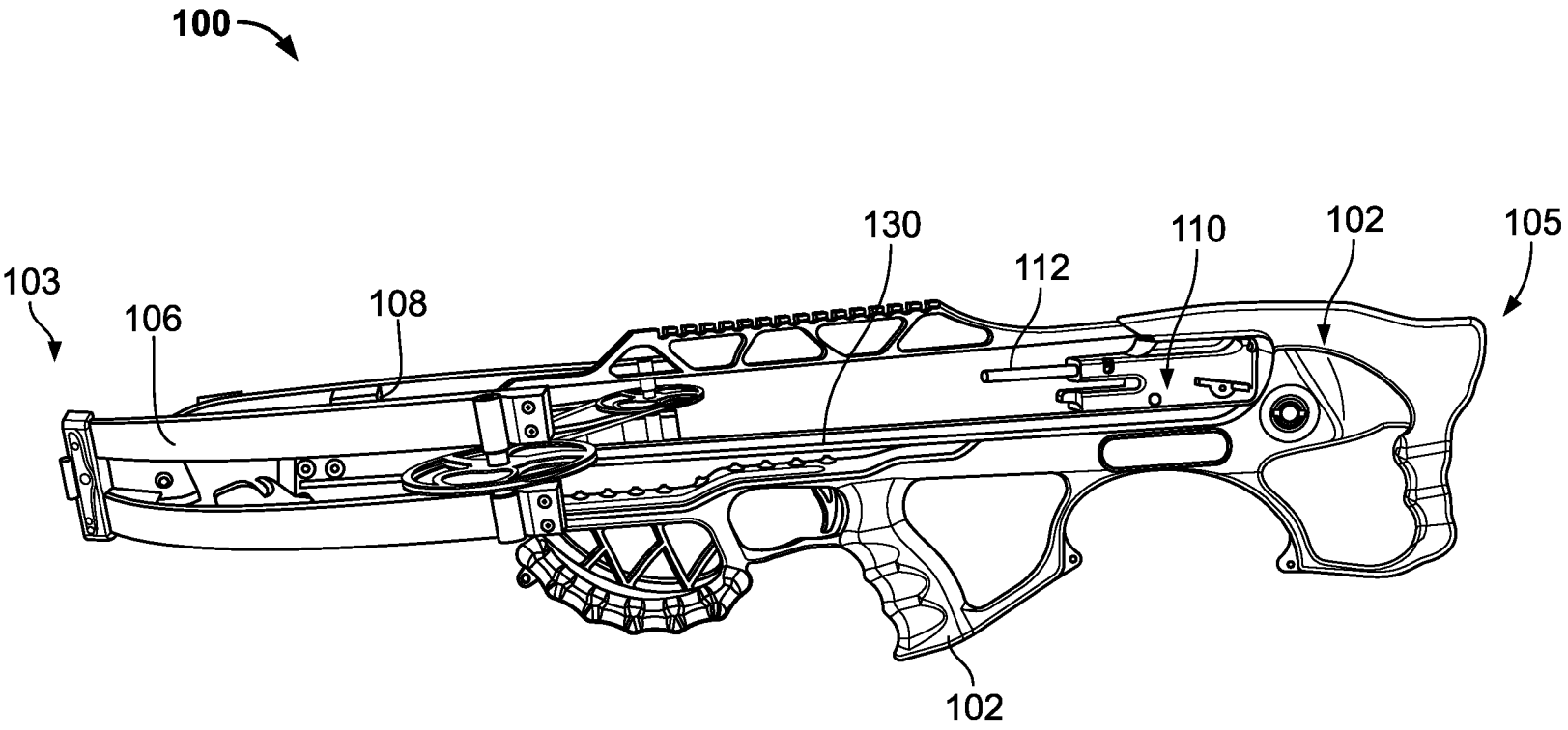
FIG. 6 is a left perspective view of the crossbow of FIG. 1 with a projectile in an aligned rotational position.

In some examples, the latch 110 is movable along a rail 130 between the front and rear ends 103, 105 of the frame 102. FIG. 4 shows the latch 110 positioned at a forward-most position on the frame 102. FIG. 5 shows the latch 110 positioned between the forward-most position and a rearward-most position on the frame 102. FIG. 6 shows the latch 110 positioned at the rearward-most position on the frame 102.

As shown, the latch 110 is attached to the frame 102 via a tether 117. The tether 117 is extended from the frame 102 as the latch 110 moves from the rearward-most position toward the forward-most position. The tether 117 is retracted into the frame 102 when the latch 110 moves from the forward-most position to the rearward-most position. In some examples, the retraction of the tether 117 can be aided by an arming tool. The latch 110 can be pulled to the rear end 105 along the frame 102 of the crossbow 100 via the arming tool, e.g. a crank. In some examples, the arming tool can be selectively attached to the crossbow 100. Upon rotating the arming tool in a cranking motion, the latch 110, which can be connected to the drawstring 104 at the forward-most position, can be drawn from the forward-most position to the rearward-most position at the rear end 15 of the frame via the tether 117, thus drawing the drawstring 104. In some examples, the latch 110 remains along a straight path along the rail 130 of the frame 102. Once pulled to the rear end 105, the projectile 101 can be loaded so that the drawstring 104, once released, can propel the projectile 101 forward. In some examples, when fired, the latch 110 remains at the rear end 105 of frame 102 until released in preparation for another firing.

The projectile guide 112 is connected to the latch 110 and therefore moves with the latch 110. The projectile guide 112 is positioned adjacent to and above the projectile axis A at the rear end 105 of the frame 102. The projectile guide 112 is positioned closer to the front end 103 of the frame 102 than the nock aperture 124 of the latch 110. In some examples, the projectile guide 112 is positioned further from a portion of the frame than the nock aperture of the latch. While the projectile guide 112 is shown attached to a crossbow 100, it is considered within the scope of present disclosure that the projectile guide 112 can be used with a variety of projectile firing mechanisms such as a compound bow, a longbow, a slingshot, etc.

The projectile guide 112 promotes alignment of the projectile 101 within the latch 110 so that when the projectile 101 is fired, the likelihood that the projectile 101 will contact portions of the crossbow 100 is reduced. The projectile guide 112 is configured to contact the fletching 109, e.g., a vane 111, of the projectile 101 when the projectile 101 is in a misaligned rotational position (as shown in FIGS. 3, 5, 7, and 9). One problem with the projectile 101 being misaligned is that the fletching 109 of the projectile may come into contact with a portion of the crossbow 100 when the projectile 101 is fired. This contact can deflect the direction of the projectile 101, thus resulting in an inaccurate shot. In some examples, the projectile guide 112 is configured to contact at least one of the plurality of vanes 111 of the misaligned projectile 101 before the nock 113 of the projectile 101 is inserted all the way into the nock aperture 124 of the latch 110. In some examples, the projectile guide 112 is configured to prevent the projectile 101, specifically the nock 113, from being inserted into the nock aperture 124. In some examples, the projectile guide 112 is configured to prevent the nock 113 from being entirely inserted into the nock aperture 124. In some examples, the projectile guide 112 is configured to allow a portion of the nock 113 to be inserted into the nock aperture 124 but prevent the latch 110 from firing the projectile 101.

When the projectile 101 is in an aligned rotational position (as shown in FIGS. 4, 6, 8, and 10), the projectile guide 112 is positioned between vanes 111 of the fletching 109 of the projectile 101 and the nock 113 can easily be inserted all the way into the nock aperture 124 of the latch 110.

In some examples, the projectile guide 112 is flexible. In some examples, the projectile guide 112 is integral with the latch 110. In some examples, the projectile guide 112 is separately formed from the latch 110. In the depicted examples, the projectile guide 112 extends toward the front end 103 of the frame 102 from the main body 122 of the latch 110. In some examples, the main body 122 of the latch 110 is the projectile guide 112. In some examples, the projectile guide 112 has a length L1, shown in FIG. 2 that is equal to, or greater than a length L2 of the portion of the projectile 101 between the end of the fletching 109 and nock 113.

The trigger assembly 114 is in communication with the latch 110 so that upon activation of the trigger assembly 114 when firing (e.g., pulling the trigger toward the rear end 105 of the frame 102), the trigger assembly 114 moves portions the latch 110 and the drawstring 104 is released and free to travel toward the front end 103 of the frame 102. In some examples, the trigger assembly 114 can include a safety and/or anti-dry fire protection.

Figure 14:
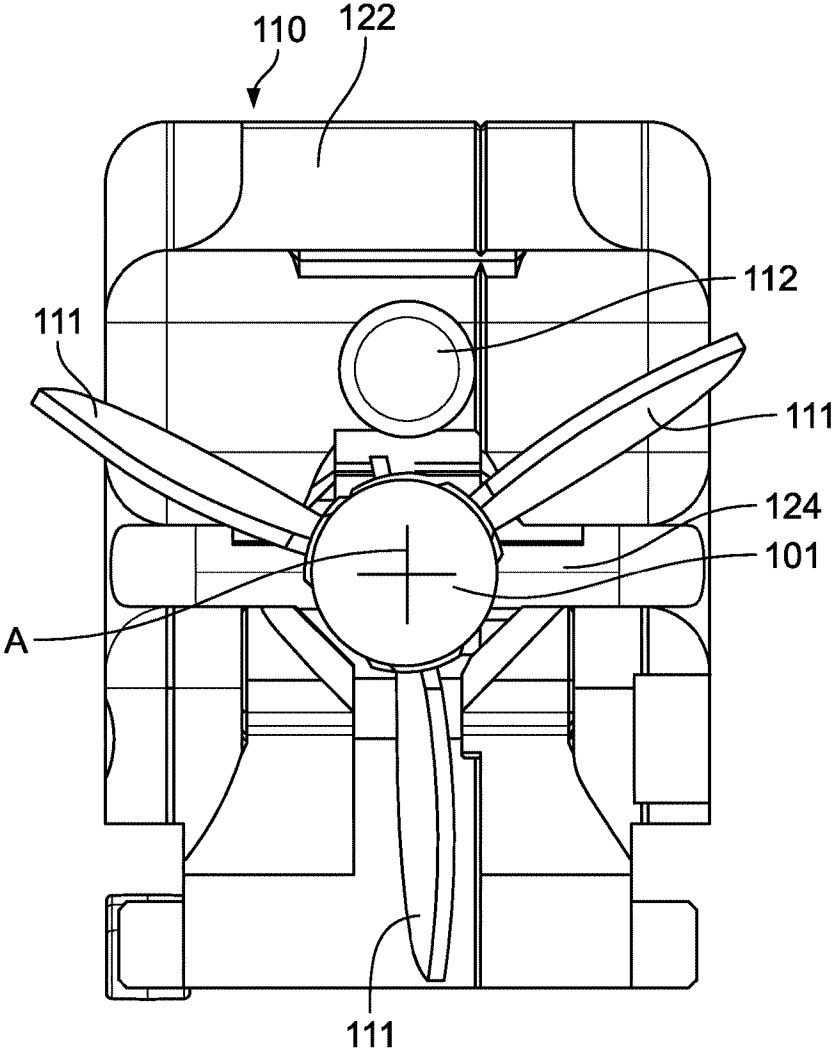
FIG. 14 is a front view of the portion crossbow of FIG. 7 with a projectile in the aligned rotational position.

The crossbow 100 can include the projectile rest 116, shown schematically in FIG. 1 and shown in detail in FIG. 14. The projectile rest 116 is mounted to the front end 103 of the frame 102 and includes an opening 125, shown in detain that is aligned with projectile axis A. The projectile rest 116 is configured to support a portion of the projectile 101. A nocking end of the projectile 101 is configured to be positioned within the latch 110 and aligned by the projectile guide 112 so that the vanes 111 do not contact the projectile rest 116 when the projectile 101 is fired. In some examples, a vane 111 of the projectile 101 passes between the portions of the projectile rest 116 when the projectile 101 is fired. In other examples, the projectile rest 116 includes bristles positioned within the opening 125 for supporting the projectile 101.

The crossbow 100 can include a plurality of accessory rails 118. In some examples, the accessory rail 118 can be a picatinny rail. In some examples, one of the accessory rails 118 is configured to receive a sighting apparatus, such as a scope. In some examples, one of the accessory rails 118 is configured to receive a lighting device, such as a flashlight.

The grip 120 provides a point of support for a user of the crossbow 100. The grip 120 can be held by the user's hand, including when operating the trigger assembly 114. The grip 120 assists the user in stabilizing the crossbow 100 during firing and handling. In some embodiments, the grip 120 is mounted to the frame 102. In some embodiments, the crossbow has a plurality of grips 120 mounted to the frame 102.

Figure 7:
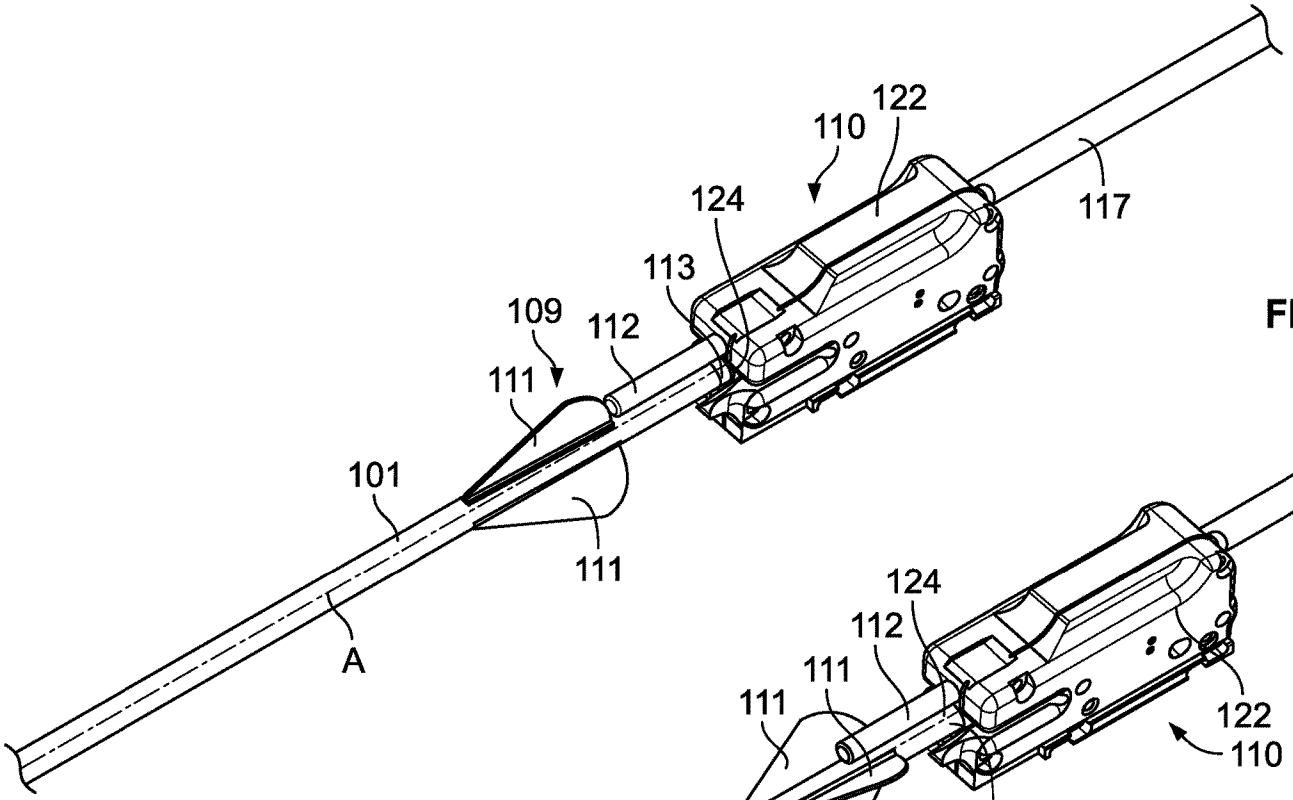
FIG. 7 is a left perspective view of a portion crossbow of FIG. 1 with a projectile in a misaligned rotational position.

FIG. 7 shows the projectile 101 in a misaligned rotational position. As shown, a vane 111 of the fletching 109 is shown contacting the projectile guide 112. Such contact impedes the insertion of the projectile 101 into the nock aperture 124 of the latch 110. Without being inserted into the nock aperture 124, the projectile 101 cannot be fired. In some examples, the user is informed of the misalignment of the projectile 101 before attempting to fire the projectile 101, thus informing the user to reduce the likelihood, and even prevent, that the projectile 101 will be fired in the misaligned rotational position.

Figure 8:
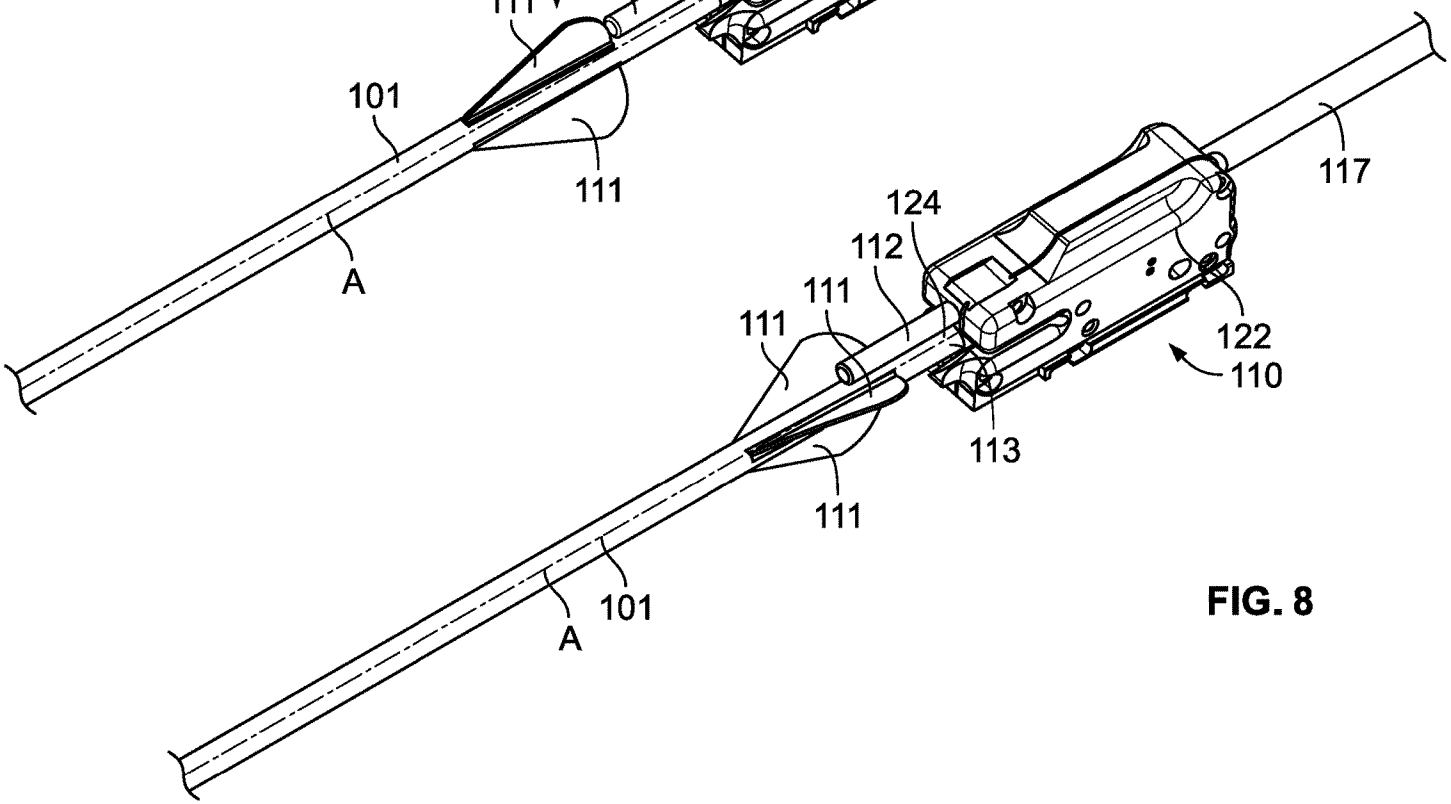
FIG. 8 is a left perspective view of a portion crossbow of FIG. 1 with a projectile in an aligned rotational position.

FIG. 8 shows the projectile 101 in the aligned rotational position. The projectile guide 112 is shown positioned between a pair of vanes 111 of the fletching 109, and the nock 113 of the projectile 101 is positioned within the nock aperture 124 of the latch 110. In some examples, the projectile guide 112 does not contact the projectile 101 when the projectile 101 is in the aligned rotational position.

Figure 9:
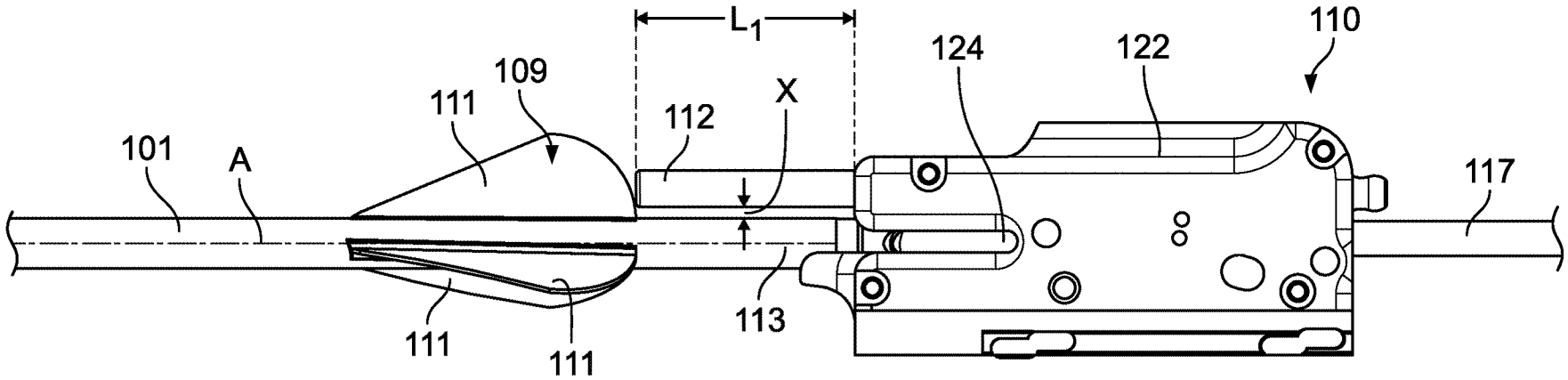
FIG. 9 is a side view of the portion crossbow of FIG. 7 with a projectile in the misaligned rotational position.

FIG. 9 shows a side view of the projectile 101 in the misaligned rotational position as the projectile guide 112 is contacting a vane 111 of the fletching 109. The length L1 of the projectile guide 112 can be of a variety of different lengths. In some examples, the length L is between 0.125 inches and 4.00 inches. In some examples, the length is 1.25 inches. In some examples, the length is such that the projectile guide 112 reaches the vane 111 to stop insertion of the nock 113 completely into the nock aperture 124.

In some examples, the projectile guide 112 is flexible. In some examples, the projectile guide 112 is constructed of a rubber material. In some examples, the projectile guide 112 is flexible so as not to damage a vane 111 of the projectile when the projectile guide 112 contacts the vane 111 when the projectile 101 is in the misaligned rotational position. In some examples, the projectile guide 112 is constructed of a rigid plastic material. In some examples, the projectile guide 112 is integral with the latch 110. In some examples, the projectile guide 112 is separately formed from the latch 110.

Figure 10:
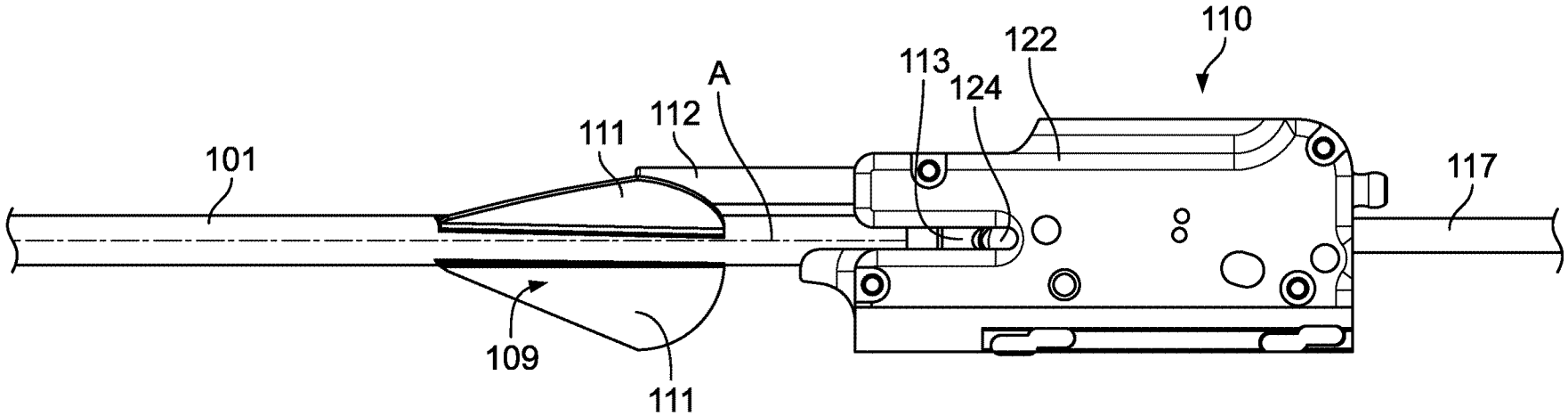
FIG. 10 is a side view of the portion crossbow of FIG. 7 with a projectile in the aligned rotational position.

FIG. 10 shows a side view of the projectile 101 in the aligned rotational position as the projectile guide 112 is positioned between vanes 111 of the fletching 109 and the nock 113 of the projectile 101 is positioned within the nock aperture 124. In some examples, the projectile guide 112 is spaced away from the projectile at a distance X when the projectile 101 is in the aligned rotational position. In some examples, the distance X is between 0.001 inches and 0.750 inches. In some examples, the distance is about 0.060 inches.

Figure 11:
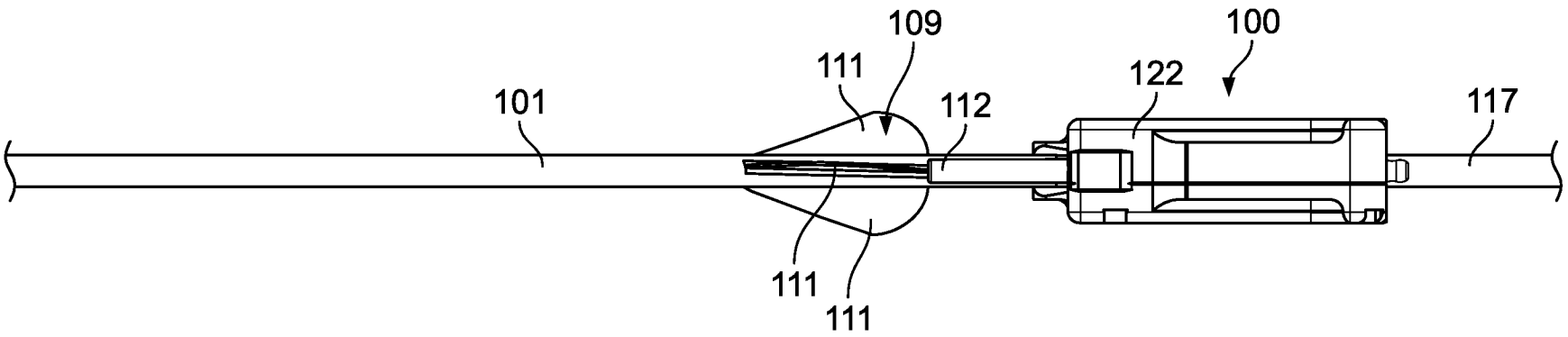
FIG. 11 is a top view of the portion crossbow of FIG. 7 with a projectile in the misaligned rotational position.

FIG. 11 shows a top view of the projectile 101 in the misaligned rotational position as the projectile guide 112 is contacting a vane 111.

Figure 12:
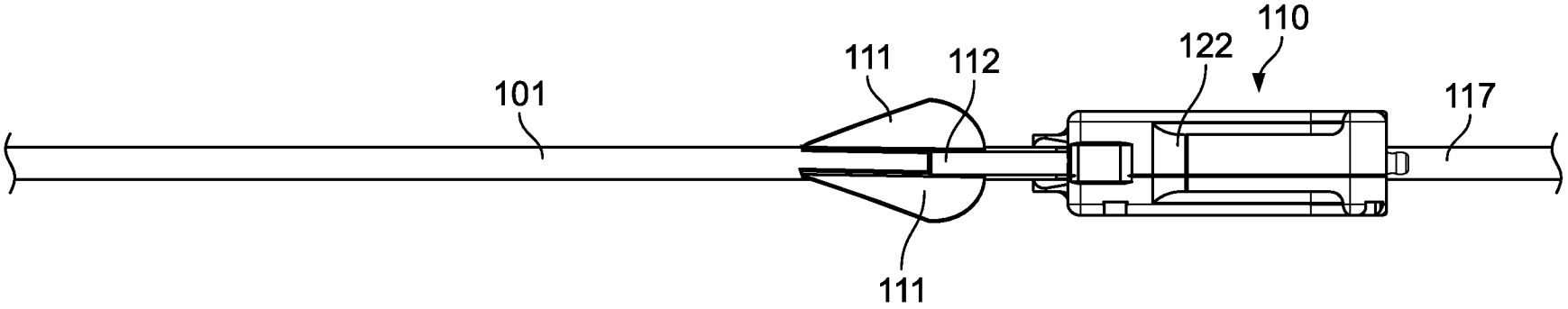
FIG. 12 is a top view of the portion crossbow of FIG. 7 with a projectile in the aligned rotational position.

FIG. 12 shows a top view of the projectile 101 in the aligned rotational position as the projectile guide 112 is positioned between vanes 111 of the fletching 109.

Figure 13:
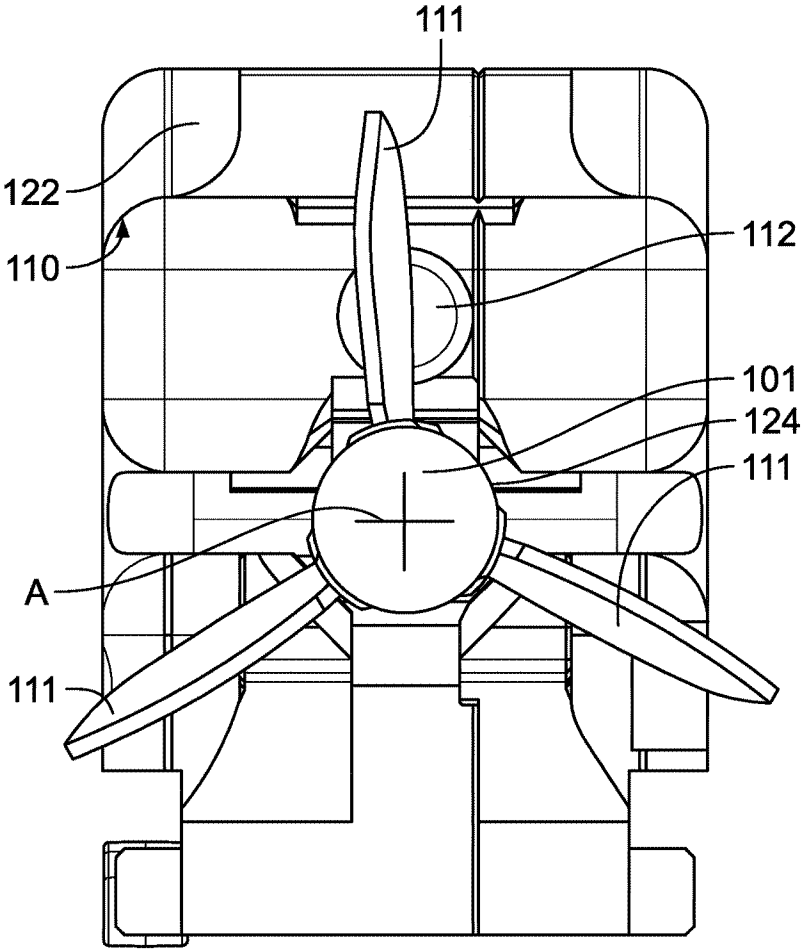
FIG. 13 is a front view of the portion crossbow of FIG. 7 with a projectile in the misaligned rotational position.

FIG. 13 shows a front view of the projectile 101 in the misaligned rotational position as the projectile guide 112 is contacting a vane 111.

FIG. 14 shows a front view of the projectile 101 in the aligned rotational position as the projectile guide 112 is positioned between vanes 111 of the fletching 109.

Figure 15:
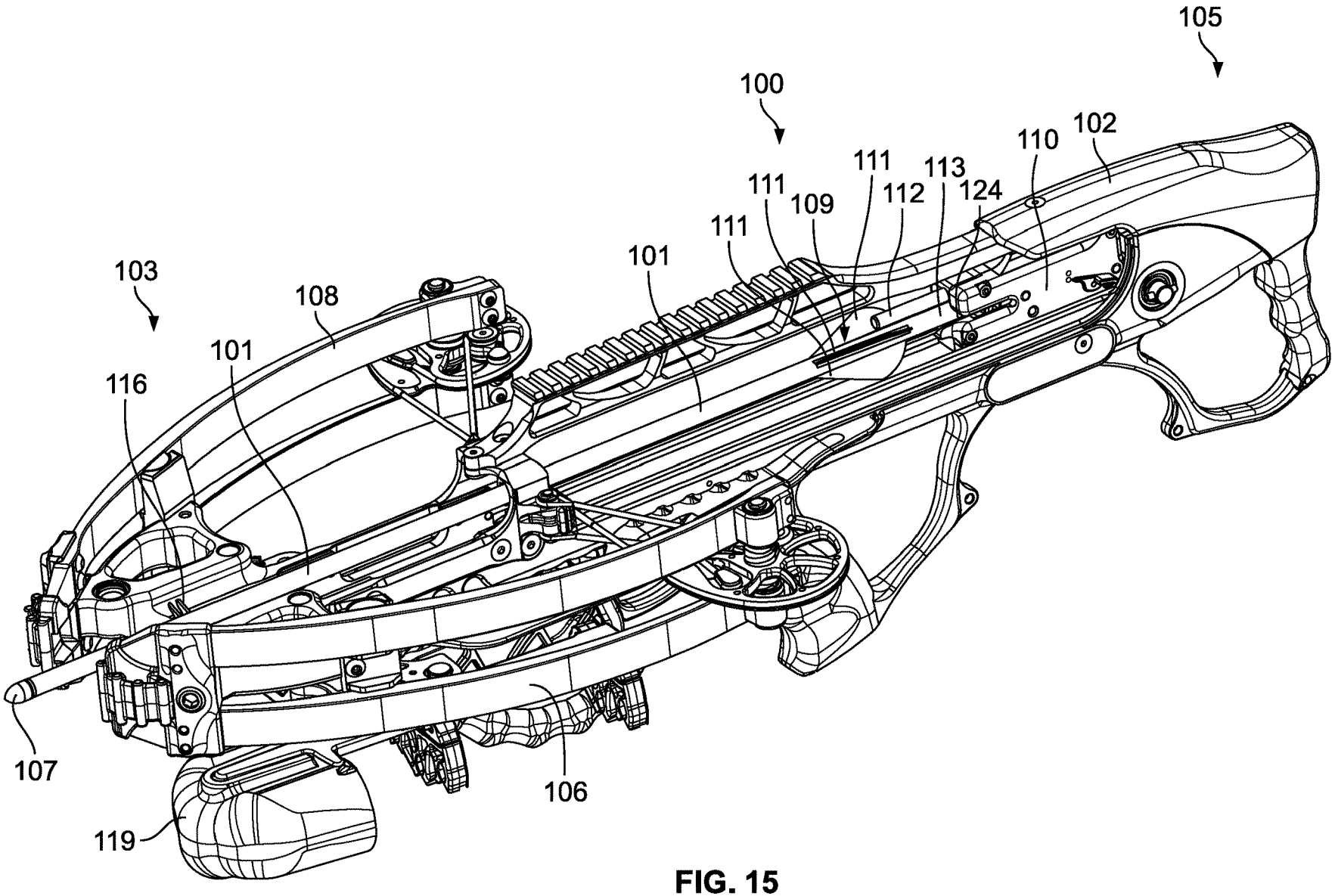
FIG. 15 is a left side perspective view of the crossbow of FIG. 1 in the drawn position with the projectile in the aligned rotational position.
Figure 16:
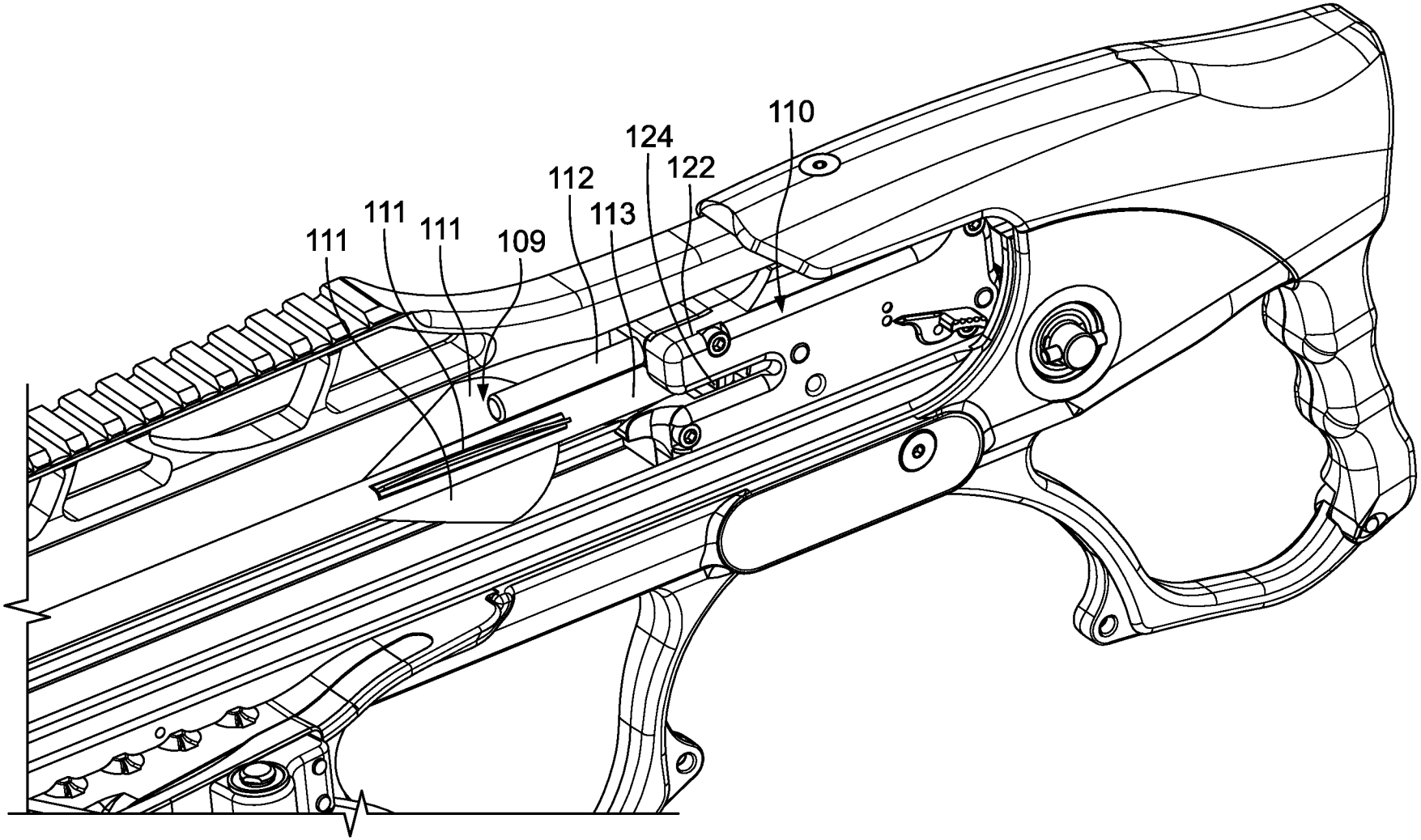
FIG. 16 is another left side perspective view of the crossbow of FIG. 1 in the drawn position with the projectile in the aligned rotational position.

FIGS. 15 and 16 show a perspective view of the crossbow 100 with the projectile in the aligned rotational position.

Figure 17:
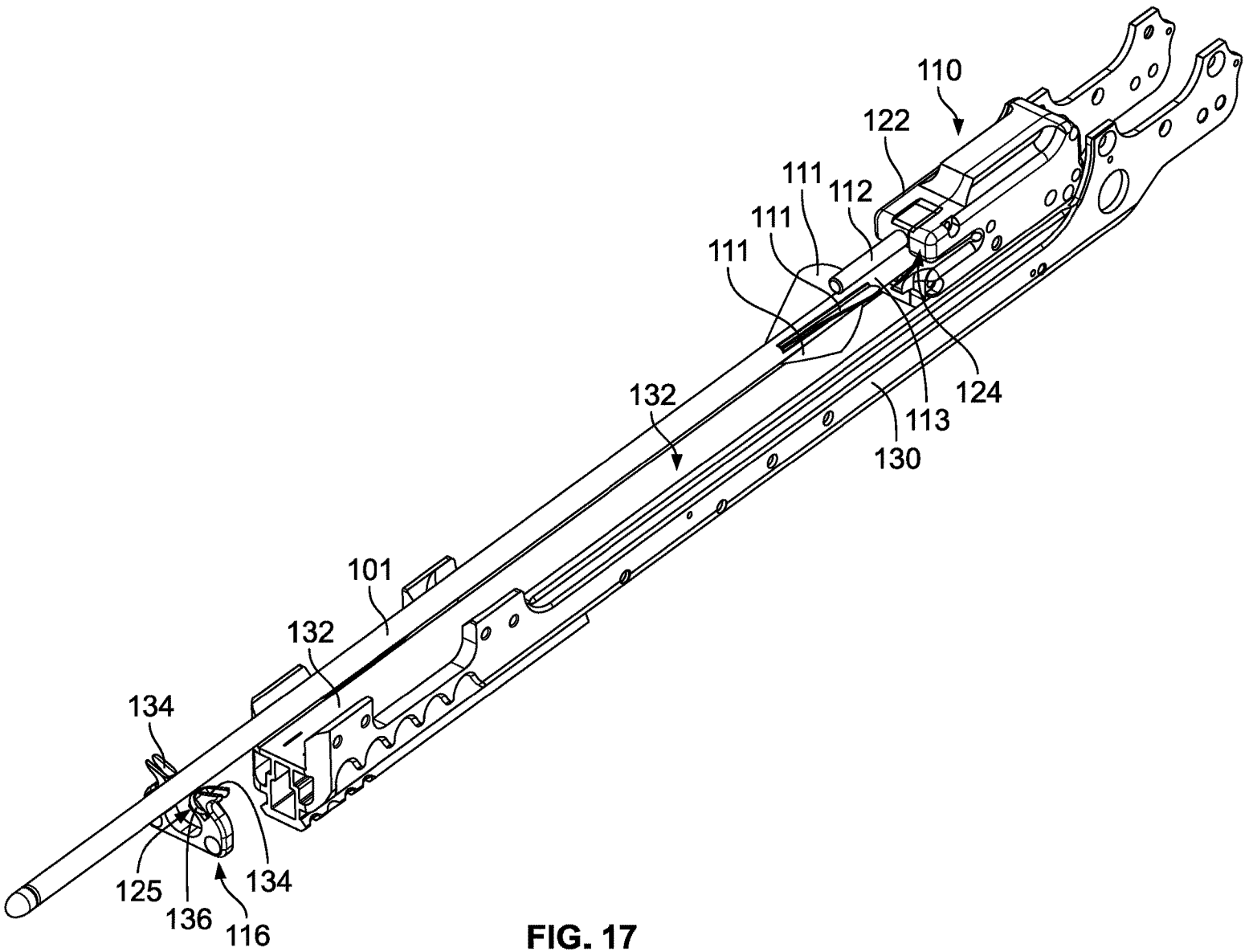
FIG. 17 is a left side perspective view of a portion of the crossbow of FIG. 1 with the projectile in the aligned rotational position.
Figure 18:
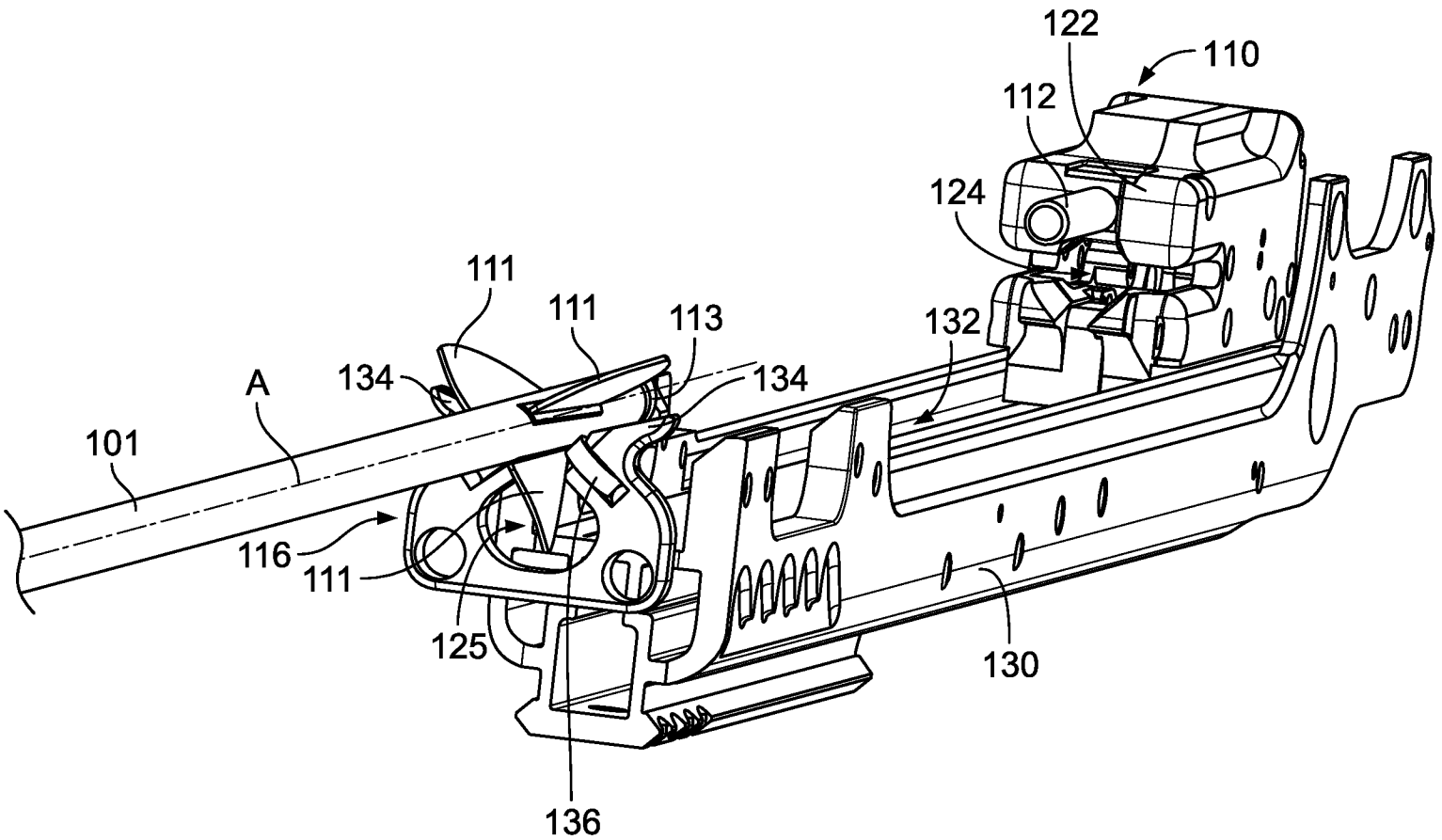
FIG. 18 is a left side perspective view of the portion of the crossbow of FIG. 17 with the projectile in the aligned rotational position between the drawn and undrawn positions.
Figure 19:
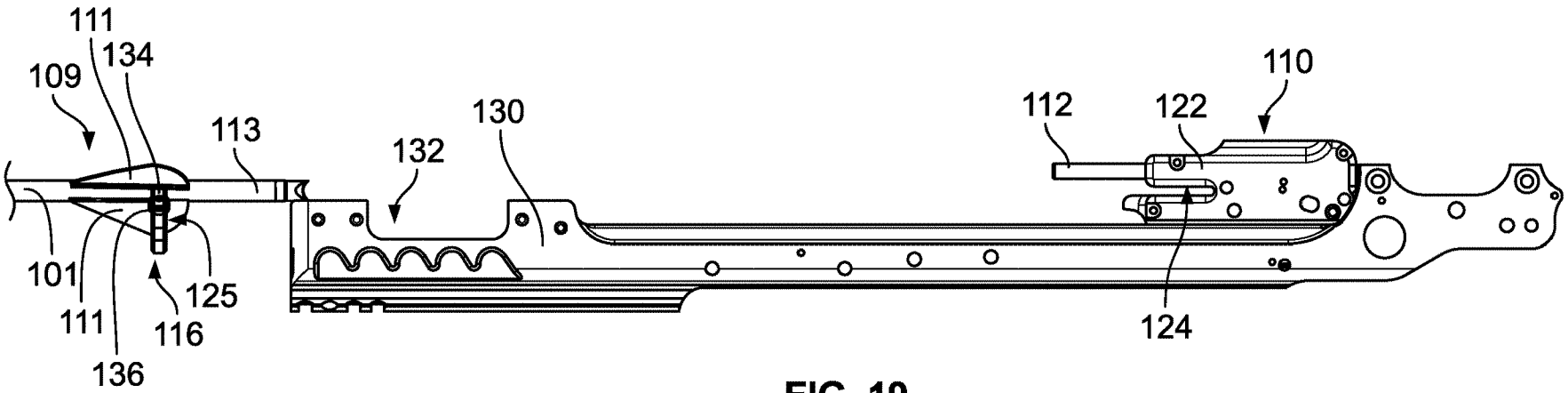
FIG. 19 is a left side view of the portion of the crossbow of FIG. 17 with the projectile in the aligned rotational position between the drawn and undrawn positions.

FIG. 17 shows a perspective view of a portion of the crossbow 100 with the projectile 101 in the aligned rotational position. FIGS. 18 and 19 show a portion of the crossbow 100 with the projectile 101 in the aligned rotational position between the drawn and undrawn positions. As shown, the frame 102 includes the rail 130. In some examples, the rail 130 has a central channel 132. In some examples, the latch 110 rides within the central channel when moving between the forward-most position and the rearward-most position. In some examples, the projectile guide 112 is positioned further from the rail 130 of the frame 102 than the nock aperture 124 of the latch 110. When the projectile 101 is fired from the aligned rotational position, a vane 111 travels through the opening 125 of the projectile rest 116 so as to allow the projectile 101 to be supported by the projectile rest 116 while the vanes 111 do not contact the projectile rest 116 when the projectile 101 is fired.

The projectile rest 116 can include a pair of arms 134 that extend to support a portion of the projectile 101. As depicted, the arms 134 include rollers 136. In some examples, the rollers 136 are configured to spin as the projectile 101 moves relative to the projectile rest 116. In some examples, the rollers 136 are stationary. In some examples, the rollers 136 are constructed from a low friction material, such as a plastic. In some examples, the projectile rest can include a single central arm 134 without and central channel and the projectile guide 112 can be configured to be a pair of extensions that extend around a single vane 111 of the projectile 101 when the projectile in the aligned rotational position.

Figure 20:
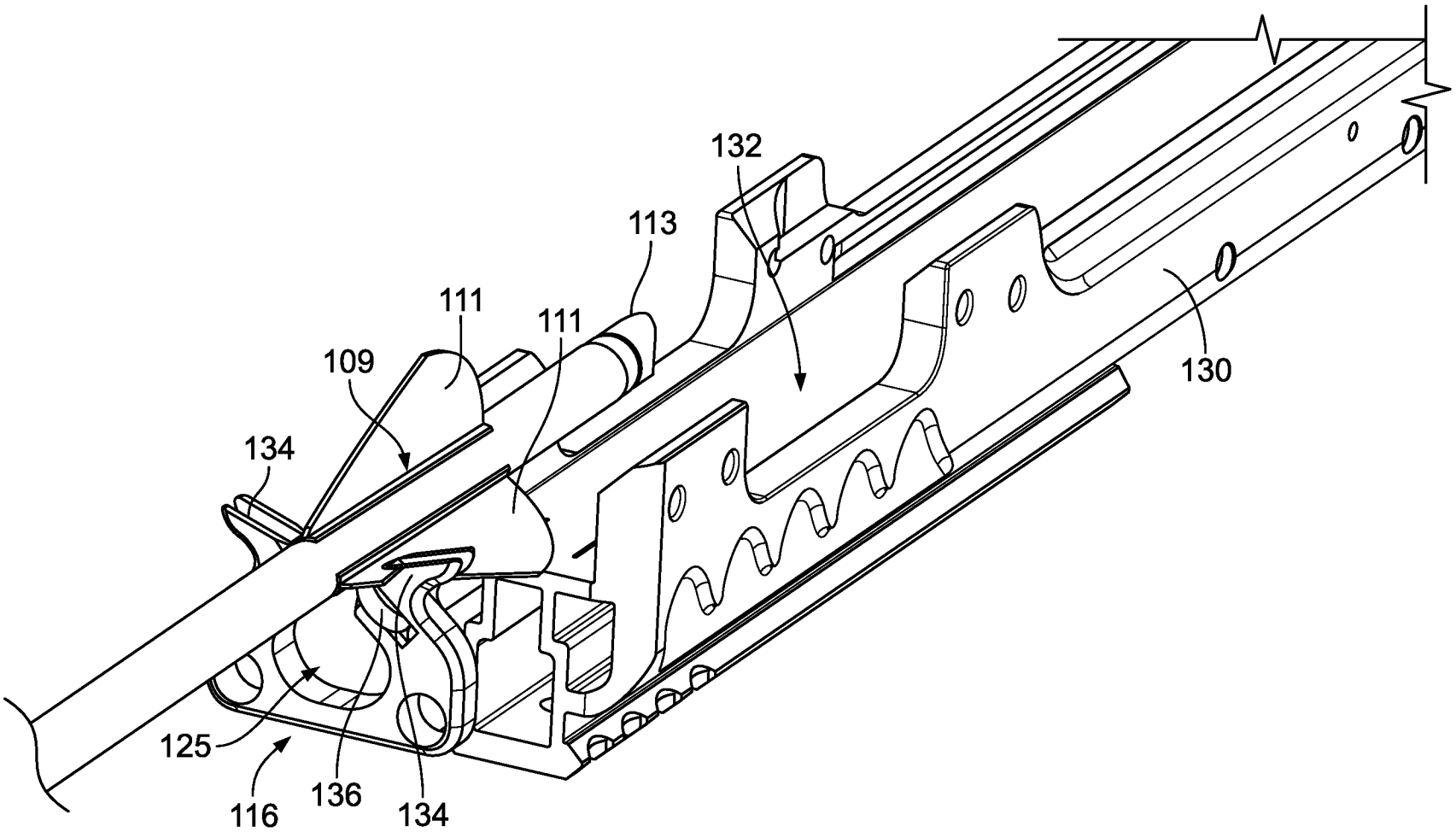
FIG. 20 is a left side perspective view of the portion of the crossbow of FIG. 17 with the projectile in the misaligned rotational position between the drawn and undrawn positions.
Figure 21:
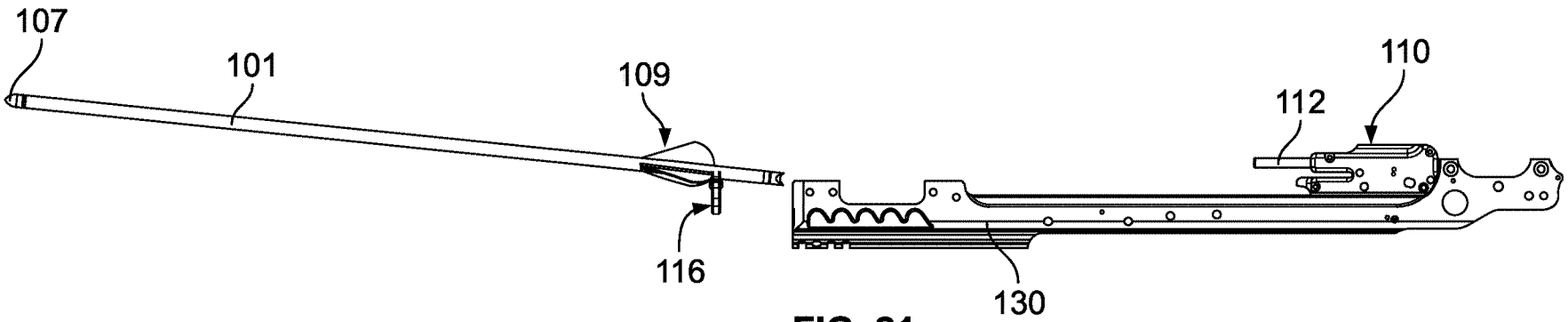
FIG. 21 is a left side view of the portion of the crossbow of FIG. 17 with the projectile in the misaligned rotational position between the drawn and undrawn positions.

FIGS. 20 and 21 show a portion of the crossbow 100 with the projectile 101 in the misaligned rotational position between the drawn and undrawn positions. Because a vane 111 of the projectile 101 does not pass within the opening 125 of the projectile rest 116, the vanes 111 of the projectile 101 contact the arms 134 of the projectile rest 116. This contact negatively impacts the trajectory and speed at which the projectile 101 is fired from the crossbow 100, as shown in FIG. 16. Such a scenario is avoided by utilizing the projectile guide 112, thus ensuring the projectile 101 cannot be loaded or fired with the projectile 101 in the misaligned rotational position.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A crossbow comprising:

a frame having a front end and a rear end, a stock being positioned at the rear end, wherein a projectile is configured to be fired from the front end of the frame, and wherein the projectile moves along a projectile axis extending between the rear end and the front end during firing;

a power source connected to the frame, the power source being configured to fire the projectile from the front end of the frame;

a latch movable between the rear end of the frame and the front end of the frame, the latch having a main body defining a nock aperture aligned with the projectile axis, the nock aperture being configured to receive a portion of the projectile therein; and a projectile guide connected to the main body of the latch and positioned adjacent the projectile axis, wherein the projectile guide is configured to interface with the projectile when the projectile is in a misaligned rotational position, and wherein the projectile guide is positioned between portions of the projectile when the projectile is in an aligned rotational position.

2. The crossbow of claim 1, wherein the projectile guide is positioned between arrow vanes of the projectile when the projectile is in the aligned rotational position.

3. The crossbow of claim 1, wherein the projectile guide is positioned above the projectile axis.

4. The crossbow of claim 1, wherein the latch is attached to a tether at a side opposite of the projectile guide, wherein the tether is retractable into the frame.

5. The crossbow of claim 1, wherein the projectile guide is positioned closer to the front end of the frame than the nock aperture of the latch.

6. The crossbow of claim 1, wherein the projectile guide is integrally formed with the main body of the latch.

7. The crossbow of claim 1, wherein the projectile guide is separately formed from the main body of the latch.

8. The crossbow of claim 1, wherein the projectile guide is positioned further from a rail of the frame than the nock aperture of the latch.

9. The crossbow of claim 1, wherein the projectile guide is positioned above the nock aperture of the latch.

10. The crossbow of claim 1, wherein the projectile guide is positioned between the nock aperture of the latch and a projectile rest.

11. The crossbow of claim 1, wherein the projectile guide is flexible.

12. The crossbow of claim 1, further comprising a projectile rest positioned at the front end of the frame, the projectile rest having a pair of arms and a central opening between the pair of arms, the pair of arms being configured to at least partially support the projectile, wherein the projectile axis is positioned between the pair of arms, and wherein a portion of the projectile passes through the central opening of the projectile rest when the projectile is fired.

13. The crossbow of claim 12, wherein the portion of the projectile that passes through the central opening is an arrow vane.

14. The crossbow of claim 12, wherein the pair of arms of the projectile rest includes rollers configured to interface with the projectile.

15. The crossbow of claim 1, wherein the power source is at least one flexible limb.

16. The crossbow of claim 1, further comprising a drawstring connected to the power source and configured to propel the projectile from the front end of the frame.

17. A crossbow comprising:

a frame having a front end and a rear end, a stock being positioned at the rear end, wherein a projectile is configured to be fired from the front end of the frame, and wherein the projectile moves along a projectile axis extending between the rear end and the front end during firing;

first and second flexible limbs each having a first end attached to the frame, wherein the first and second flexible limbs are in an unloaded position when the crossbow is undrawn and in a loaded position when the crossbow is drawn;

a drawstring being connected to the first and second flexible limbs, the drawstring traveling at least partially perpendicular to the projectile axis;

a projectile rest positioned at the front end of the frame, the projectile rest having a pair of arms and a central channel between the pair of arms, the pair of arms being configured to at least partially support the projectile, wherein the projectile axis is positioned between the pair of arms;

a latch movable between the rear end of the frame and the front end of the frame, the latch being configured to receive the drawstring and hold the drawstring at the rear end of the frame when the crossbow is drawn, the latch having a main body defining a nock aperture aligned with the projectile axis, the nock aperture being configured to receive a portion of the projectile and the drawstring therein;

a trigger assembly being in communication with the latch, wherein upon activation of the trigger assembly when firing, the trigger assembly moves the latch and the drawstring is released from the latch; and a projectile guide extending from the main body of the latch toward the projectile rest and above the projectile axis, the projectile guide being positioned closer to the front end of the frame than the nock aperture of the latch and further from a rail of the frame than the nock aperture of the latch, wherein the projectile guide is configured to interface with the projectile when the projectile is in a misaligned rotational position, and wherein the projectile guide is positioned between portions of the projectile when the projectile is in an aligned rotational position.

18. The crossbow of claim 17, wherein the portions of the projectile the projectile guide is positioned between when the projectile is in the aligned rotational position are arrow vanes.

19. A projectile guide system for a crossbow, the projectile guide system comprising:

a latch movable along a frame of a crossbow, the latch having a main body defining a nock aperture aligned with a projectile axis, the nock aperture being configured to receive a portion of a projectile therein; and a projectile guide extending from the main body of the latch, wherein the projectile guide is configured to interface with the projectile when the projectile is in a misaligned rotational position, and wherein the projectile guide is positioned between portions of the projectile when the projectile is in an aligned rotational position.

20. The projectile guide of claim 19, wherein the projectile guide is integrally formed with the main body of the latch.

21. The projectile guide of claim 19, wherein the projectile guide is separately formed from the main body of the latch.

22. The projectile guide of claim 19, wherein the projectile guide is positioned above the projectile axis.

23. The projectile guide of claim 19, wherein the projectile guide and the latch are attached to the crossbow.

24. The projectile guide of claim 19, further comprising a tether attached to a side of the main body opposite of the projectile guide, wherein the tether is configured to be attached the frame of a crossbow.

* * * * *